US010584020B2

(12) United States Patent
Sung et al.

(10) Patent No.: US 10,584,020 B2
(45) Date of Patent: Mar. 10, 2020

(54) HYDRAULIC HEIGHT ADJUSTMENT DEVICE FOR INSTALLING ULTRA-HEAVY STRUCTURE

(71) Applicants: KOREA INSTITUTE OF OCEAN SCIENCE & TECHNOLOGY, Busan (KR); GLORIA CO., LTD., Changwon-si, Gyeongsangnam-do (KR)

(72) Inventors: Hong Gun Sung, Daejeon (KR); Dong Ho Jung, Daejeon (KR); Jak Son, Changwon-si (KR); Wang Soo Ryu, Gimhae-si (KR); Hyeong Woo Nam, Jinju-si (KR)

(73) Assignees: KOREA INSTITUTE OF OCEAN SCIENCE & TECHNOLOGY (KR); GLORIA CO., LTD. (KR)

( * ) Notice: Subject to any disclaimer, the term of this patent is extended or adjusted under 35 U.S.C. 154(b) by 0 days.

(21) Appl. No.: 16/438,744

(22) Filed: Jun. 12, 2019

(65) Prior Publication Data

US 2019/0292028 A1 Sep. 26, 2019

Related U.S. Application Data

(63) Continuation of application No. PCT/KR2017/014838, filed on Dec. 15, 2017.

(51) Int. Cl.
*E02B 17/08* (2006.01)
*B66F 3/32* (2006.01)
(Continued)

(52) U.S. Cl.
CPC ..... *B66F 3/32* (2013.01); *B63B 17/00* (2013.01); *B63B 35/003* (2013.01);
(Continued)

(58) Field of Classification Search
CPC ..... B66F 3/25; B66F 3/46; E02B 17/08
(Continued)

(56) References Cited

FOREIGN PATENT DOCUMENTS

CN 204038958 U 12/2014
JP 05-010396 U 2/1993
(Continued)

OTHER PUBLICATIONS

Korean Office Action (KR 10-2016-0175482), KIPO, dated Mar. 6, 2017.

(Continued)

*Primary Examiner* — Sunil Singh
(74) *Attorney, Agent, or Firm* — Park & Associates IP Law, P.C.

(57) ABSTRACT

The present invention relates to a hydraulic height adjusting device for installing a heavy-weight structure to secure stable horizontal bearing power against a horizontal load of a heavy-weight upper structure. The present invention includes a lower frame which is installed on a top surface of the carrier and is provided with a plurality of receiving portions formed in an upwardly opened shape; and a hydraulic cylinder which is disposed in and engaged to the respective receiving portions of the lower frame, the hydraulic cylinder being moved in a vertical direction to adjust the height of the upper structure, in a state in which an upper end thereof supports the upper structure. The receiving portion is provided with a support guide which is interposed between an inner wall of the receiving portion and the hydraulic cylinder to annually enclose the hydraulic cylinder and thus prevent the hydraulic cylinder from being tilted.

6 Claims, 15 Drawing Sheets

(51) Int. Cl.

| | |
|---|---|
| ***B63B 35/00*** | (2020.01) |
| ***B63B 35/44*** | (2006.01) |
| ***B66F 9/04*** | (2006.01) |
| ***B63B 17/00*** | (2006.01) |
| ***B66F 3/46*** | (2006.01) |
| ***B66F 3/25*** | (2006.01) |

(52) U.S. Cl.
CPC ..... *B63B 35/4406* (2013.01); *B66F 3/25* (2013.01); *B66F 3/46* (2013.01); *B66F 9/04* (2013.01); *E02B 17/08* (2013.01)

(58) Field of Classification Search
USPC ..... 405/203–206, 209
See application file for complete search history.

(56) References Cited

FOREIGN PATENT DOCUMENTS

| | | | |
|---|---|---|---|
| KR | 10-0658882 | B1 | 12/2006 |
| KR | 10-2012-0077983 | A | 7/2012 |
| KR | 10-2014-0096904 | A | 8/2014 |
| KR | 10-1586376 | B1 | 1/2016 |
| KR | 10-1607913 | B1 | 3/2016 |

OTHER PUBLICATIONS

Korean Decision to Grant (KR 10-2016-0175482), KIPO, dated Jul. 3, 2017.
International Search Report (PCT/KR2017/014838), WIPO, dated Mar. 21, 2018.

HYDRAULIC HEIGHT ADJUSTMENT DEVICE FOR INSTALLING ULTRA-HEAVY STRUCTURE

REFERENCE TO RELATED APPLICATIONS

This is a continuation of pending International Patent Application PCT/KR2017/014838 filed on Dec. 15, 2017, which designates the United States and claims priority of Korean Patent Application No. 10-2016-0175482 filed on Dec. 21, 2016, the entire contents of which are incorporated herein by reference.

FIELD OF THE INVENTION

The present invention relates to a hydraulic height adjusting device for installing a heavy-weight structure, and more particularly, to an apparatus capable of adjusting a height of a heavy-weight offshore structure, which is installed on the sea, by lifting the marine structure.

In case of installing a heavy-weight upper structure to a stationary structure on the sea, a marine carrier for transporting the upper structure is rolled by environmental effects (e.g., wind speed or waves) generated on the sea, so that the upper structure is moved in a horizontal direction by the rolling of the marine carrier.

Therefore, there is required for an apparatus capable of securing stability of the heavy-weight upper structure against a horizontal load, in addition to work time reduction.

The present invention relates to a hydraulic height adjusting device capable of safely installing a heavy-weight upper structure to a stationary structure fixed to a seabed, in addition to work time reduction.

BACKGROUND OF THE INVENTION

The present invention relates to an apparatus for installing a heavy-weight upper structure, wherein a height of the heavy-weight upper structure loaded on a marine carrier is properly adjusted by a hydraulic height adjusting device to safely put the heavy-weight upper structure on a stationary lower structure installed to a seabed.

The process of putting down the heavy-weight upper structure combines with a process of introducing or draining sea water to or from a vessel to change a ballast of the vessel.

The conventional installation of the heavy-weight marine structure includes a method of lifting and lowering the heavy-weight upper structure by a marine crane and a method of putting down the heavy-weight upper structure by the ballast change of the marine carrier.

According to the method employing the marine crane, as the total weight of the upper structure is limited by lifting capability of the marine crane, the upper structure is separately manufactured, or a part of the upper structure is separately mounted thereon. In this instance, since the upper structure or equipment which is separately manufactured should be separately manufactured, transported, mounted and test-driven, an offshore installing period is extended, and the method is inefficient in view of economics, safety and efficiency.

Also, since the method employing the ballast change of the marine carrier depends on the ballast capacity of the carrier, it is not possible to quickly respond to the change of the marine environmental factors (e.g., wind speed and waves) during the process of installing the heavy-weight upper structure, and there is a limit to the reduction of the work time.

FIGS. 1 and 2 show an offshore structure installing apparatus having a member for adjusting a height of an upper structure by a hydraulic unit which is disclosed in Korean Patent Publication No. 10-0658882.

Referring to FIGS. 1 and 2, an upper structure 2 is disposed on a carrier 3, in which the carrier 3 transports the upper structure to an offshore installation location, with the upper structure 2 being supported by a height adjusting member 6 having hydraulic units 7*a* and 7*b*.

The height adjusting unit 6 includes a lower bearing block 9*a* with a receiving hole for a guide portion 8 at a center thereof, the hydraulic units 7*a* and 7*b* each installed at both sides of the lower bearing block 9*a* to adjust the height of the upper structure 2, the guide portion 8 fitted into the receiving hole of the lower bearing block 9*a*, and an upper plate 9*b* installed on the guide portion 8 and having both ends connected to an upper portion of the respective hydraulic units 7*a* and 7*b*.

The upper plate 9*b* is lifted by the hydraulic units 7*a* and 7*b*, and the guide portion 8 connected to the upper plate 9*b* is guided by the receiving hole of the lower bearing block 9*a* in a vertical direction to adjust the height, thereby adjusting the height of the upper structure 2 installed thereon. Therefore, the upper structure can be seated on the lower structure 1 fixed to a seabed.

In case of the offshore structure installing apparatus, however, since the horizontal load of the carrier 3 or the upper structure 2 which is generated by the wind speed or waves is supported by the guide portion 8, the guide portion 8 should be manufactured as a separate large-scaled structure. Also, since the horizontal load generated from the heavy-weight upper structure should be supported, a diameter of the guide portion 8 is increased, and thus the guide portion 8 is necessarily manufactured to have sufficient strength.

In addition, because of the increased weight of the structure and separate production of the structure, a manufacturing cost is increased.

Since the upper plate 9*b* for supporting the upper structure 2 is supported by the pair of hydraulic units 7*a* and 7*b* and the guide portion 8 interposed between the hydraulic units, a little tilting which can be produced by the pair of hydraulic units 7*a* and 7*b* and the guide portion 8 cannot be allowed. Therefore, a fatigue loaded is structurally accumulated due to the continuous generation of the horizontal load of the carrier 3 or the upper structure 2.

SUMMARY OF THE INVENTION

Accordingly, the present invention has been made in view of the above-mentioned problems occurring in the related art.

An object of the present invention is to provide an apparatus capable of securing stable horizontal bearing power against a horizontal load of a heavy-weight upper structure which is generated due to rolling of a marine carrier caused by wind speed and waves on the sea, during a process of installing the heavy-weight upper structure, capable of quickly responding to change of the marine environmental factors during offshore work, and capable of reducing a work time.

Another object of the present invention is to provide an apparatus capable of providing effective bearing power, in addition to a compact configuration, to support a horizontal load generated from a marine carrier or an upper structure due to wind speed and waves.

To accomplish the above-mentioned object, according to a first aspect of the present invention, there is provided a hydraulic height adjusting device for installing a heavy-weight structure to adjust a height of an upper structure by supporting the upper structure, the hydraulic height adjusting device comprising: a lower frame which is provided with a plurality of receiving portions formed in an upwardly opened shape; and a hydraulic cylinder which is disposed in and engaged to the respective receiving portions of the lower frame, the hydraulic cylinder being moved in a vertical direction to adjust the height of the upper structure, in a state in which an upper end thereof supports the upper structure, wherein the receiving portion is provided with a support guide which is interposed between an inner wall of the receiving portion and the hydraulic cylinder to annually enclose the hydraulic cylinder and thus prevent the hydraulic cylinder from being tilted.

The hydraulic cylinder includes a hydraulic cylinder body positioned at an upper portion, and a hydraulic cylinder rod positioned at a lower portion and being moved in the vertical direction; a lower end of the hydraulic cylinder rod is engaged to a bottom surface of the receiving portion by a lower end engaging portion; the hydraulic cylinder rod is provided therein with a pair of fluid channels along a longitudinal direction; the pair of fluid channels have inlet/outlet ports at a lower end of the hydraulic cylinder rod, respectively, so that operating oil flows through the pair of fluid channels, and the hydraulic cylinder body moves along the hydraulic cylinder rod in the vertical direction; and the lower end engaging portion has a bottom fixing member fixed to a bottom of the receiving portion, a lower head portion of the hydraulic cylinder rod which comes into surface contact with the bottom fixing member to allow the hydraulic cylinder rod to move against the bottom fixing member, and a restrain member for restraining the lower head portion to prevent the lower head portion from being released from the bottom fixing member.

A top surface of the bottom fixing member has a concave surface which is a spherical surface, and a bottom surface of the lower head portion of the hydraulic cylinder rod which comes into contact with the bottom fixing member is a convex surface which is a spherical surface, so that the convex surface and the concave surface come into surface contact with each other to allow the movement.

All outer sides of the support guide are respectively provided with a lateral support part to support the support guide from a lateral direction, and the lateral support part includes a support cylinder body installed to the lower frame, a support cylinder rod disposed in the support cylinder body and horizontally moving toward or away from the receiving portion to apply bearing power to the support guide, an opening/closing valve for controlling flow of the operating oil into or from the support cylinder body, and a controller for controlling operation of the opening/closing valve.

According to another aspect of the present invention, there is provided an apparatus for installing a heavy-weight offshore structure to place an upper structure on a lower structure installed to a seabed, the apparatus comprising: a carrier; and a hydraulic height adjusting device installed to an upper portion of the carrier at plural positions to support the upper structure and adjust a height thereof, the hydraulic height adjusting device including a lower frame which is installed on a top surface of the carrier and is provided with a plurality of receiving portions formed in an upwardly opened shape; and a hydraulic cylinder which is disposed in and engaged to the respective receiving portions of the lower frame, the hydraulic cylinder being moved in a vertical direction to adjust the height of the upper structure, in a state in which an upper end thereof supports the upper structure, wherein the receiving portion is provided with a support guide which is interposed between an inner wall of the receiving portion and the hydraulic cylinder to annually enclose the hydraulic cylinder and thus prevent the hydraulic cylinder from being tilted.

The hydraulic cylinder includes a hydraulic cylinder body positioned at an upper portion, and a hydraulic cylinder rod positioned at a lower portion and being moved in the vertical direction; a lower end of the hydraulic cylinder rod is engaged to a bottom surface of the receiving portion by a lower end engaging portion; the hydraulic cylinder rod is provided therein with a pair of fluid channels along a longitudinal direction; the pair of fluid channels have inlet/outlet ports at a lower end of the hydraulic cylinder rod, respectively, so that operating oil flows through the pair of fluid channels, and the hydraulic cylinder body moves along the hydraulic cylinder rod in the vertical direction; and the lower end engaging portion has a bottom fixing member fixed to a bottom of the receiving portion, a lower head portion of the hydraulic cylinder rod which comes into surface contact with the bottom fixing member to allow the hydraulic cylinder rod to move against the bottom fixing member, and a restrain member for restraining the lower head portion to prevent the lower head portion from being released from the bottom fixing member.

A top surface of the bottom fixing member has a concave surface which is a spherical surface, and a bottom surface of the lower head portion of the hydraulic cylinder rod which comes into contact with the bottom fixing member is a convex surface which is a spherical surface, so that the convex surface and the concave surface come into surface contact with each other to allow the movement, all outer sides of the support guide are respectively provided with a lateral support part to support the support guide from a lateral direction, and the lateral support part includes a support cylinder body installed to the lower frame, a support cylinder rod disposed in the support cylinder body and horizontally moving toward or away from the receiving portion to apply bearing power to the support guide, an opening/closing valve for controlling flow of the operating oil into or from the support cylinder body, and a controller for controlling operation of the opening/closing valve.

With the above configuration of the present invention, the present invention can secure the stability against the change of the horizontal load of the heavy-weight upper structure which is caused by rolling of the carrier due to wind speed and waves during installation of the marine structure, without using a separate support structure.

Also, by quickly adjusting the height of the heavy-weight upper structure by the integrated hydraulic height adjusting device according to the condition of work, it is possible to quickly respond to the change of the marine environmental factors (e.g., wind speed and waves), and the offshore installation can be effectively performed in view of economics and safety of work, as compared to the related art.

In addition, the present invention can obtain useful effects in the field of internal and external marine construction, in view of economics, safety and efficiency.

DETAILED DESCRIPTION OF THE INVENTION

Hereinafter, embodiments of the present invention will be explained in detail in conjunction with the accompanying drawings.

Figure 1:
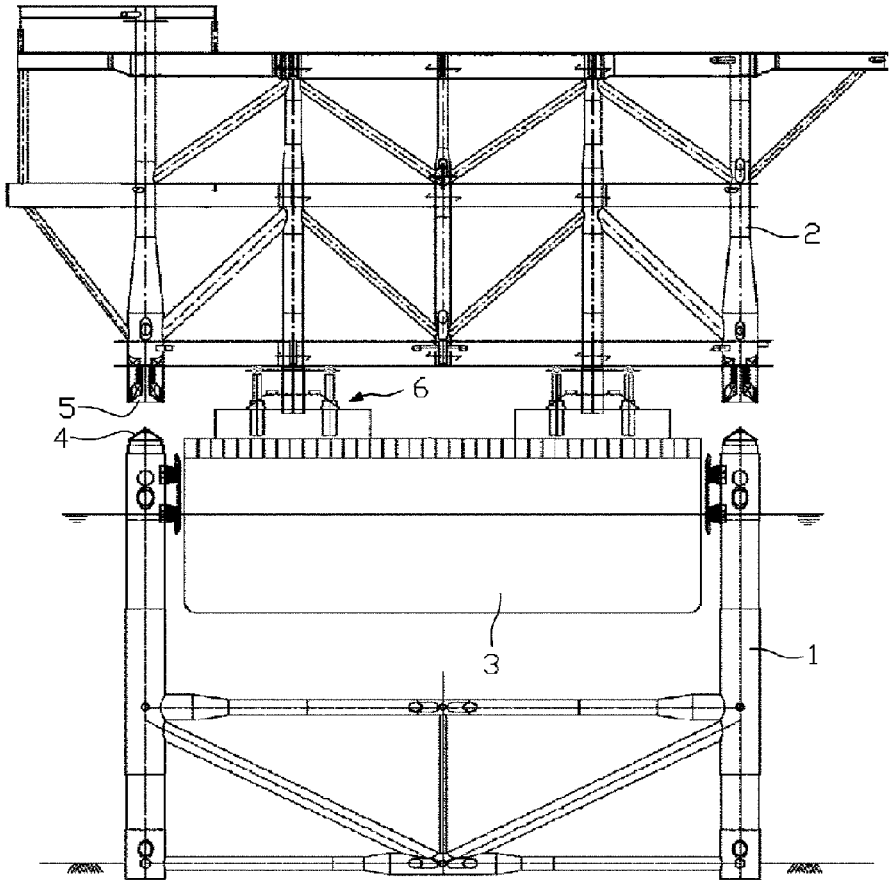
FIG. 1 (PRIOR ART)
FIG. 1 is view illustrating a process of installing a structure on the sea according to the related art.
Figure 2:
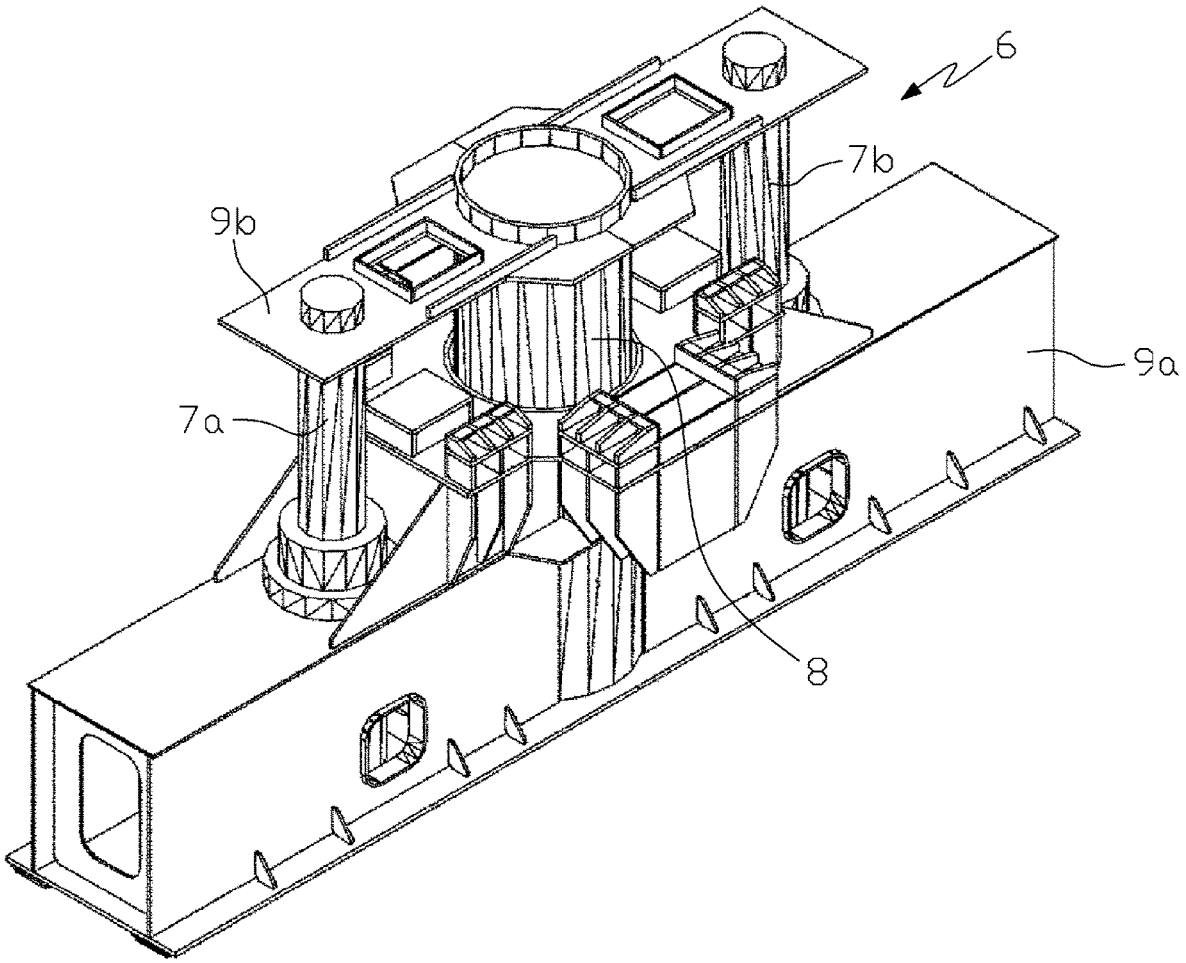
FIG. 2 (PRIOR ART)
FIG. 2 is a perspective view illustrating the configuration of a height adjusting device for supporting an upper structure according to the related art, when the upper structure is installed to a lower structure.
Figure 3:
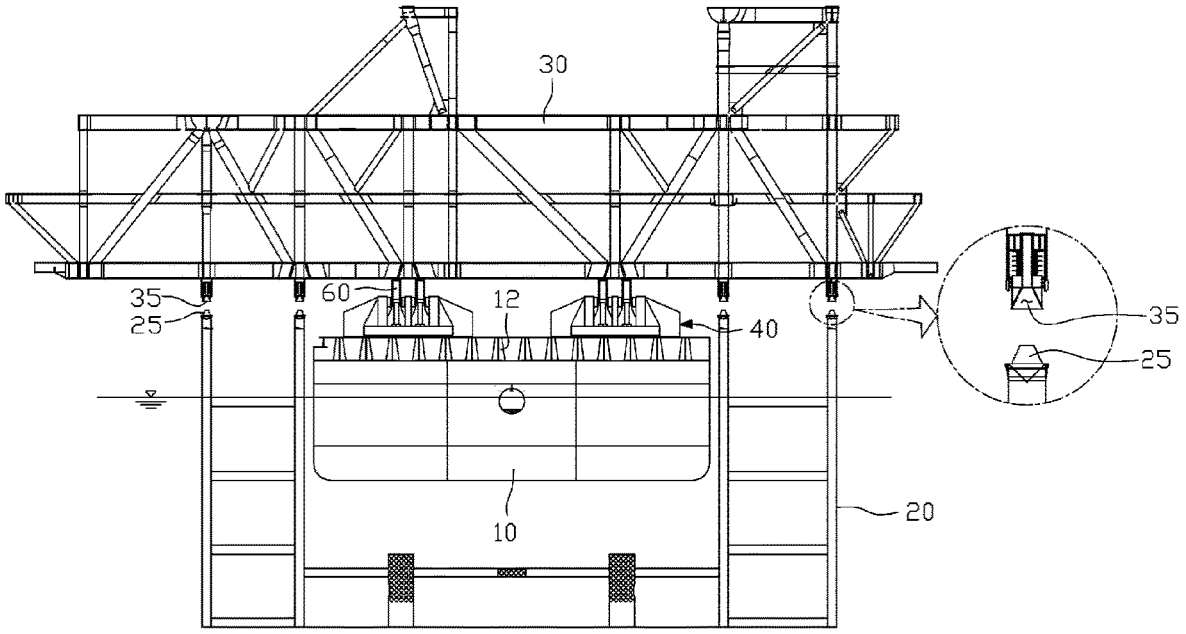
FIG. 3 is a view illustrating a process of placing an upper structure onto a lower structure for the purpose of installing a structure on the sea according to one embodiment of the present invention.

FIG. 3 is a view illustrating the state in which a heavy-weight upper structure 30 is installed to a lower structure 20 which is fixed to a seabed, according to one embodiment of the present invention, to show a process of placing the heavy-weight upper structure 30 carried by a marine carrier 10 onto the lower structure 10.

An apparatus for installing the heavy-weight offshore structure is to place the upper structure 30 onto the lower structure 20 fixed to a seabed, and includes the carrier 10 and a hydraulic height adjusting device 40 installed to an upper portion of the carrier 10 at plural positions to support the upper structure 30 and adjust a height thereof.

Figure 4:
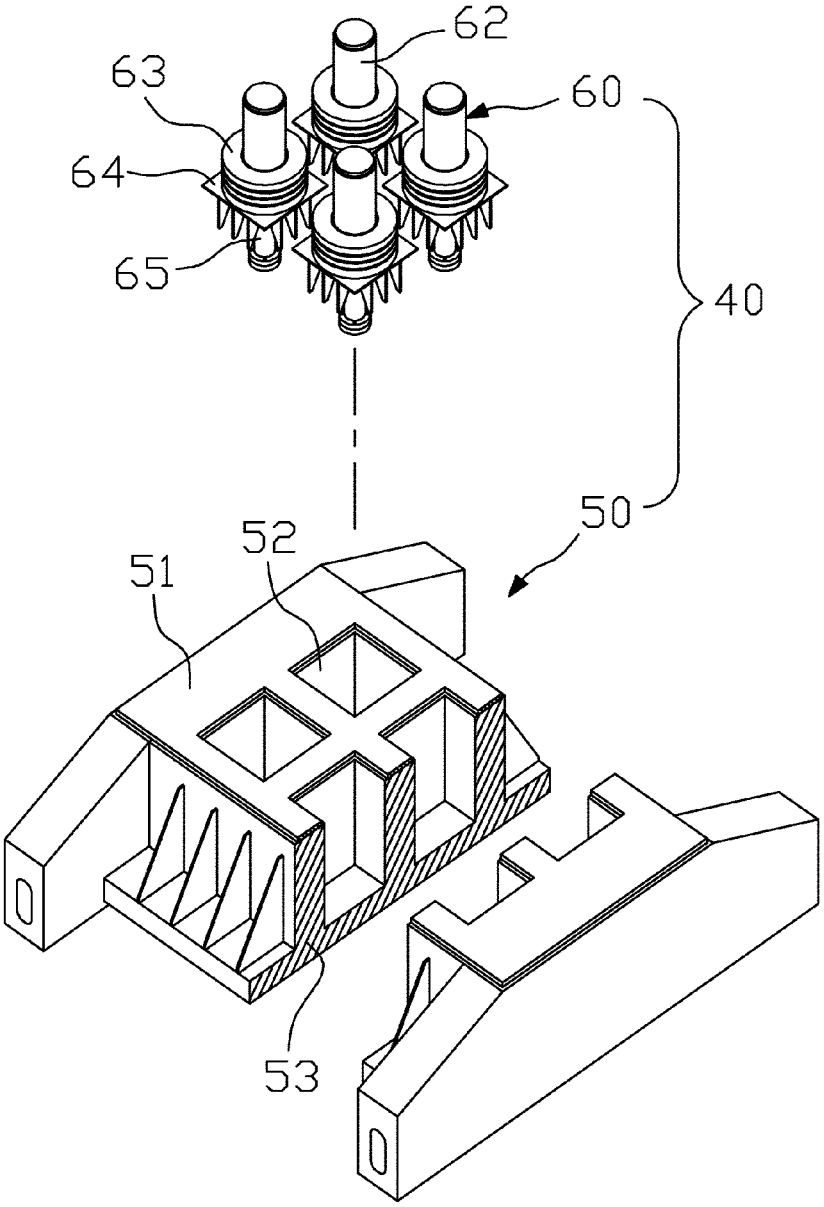
FIG. 4 is an exploded perspective view illustrating the configuration of a hydraulic height adjusting device according to one embodiment of the present invention.
Figure 5:
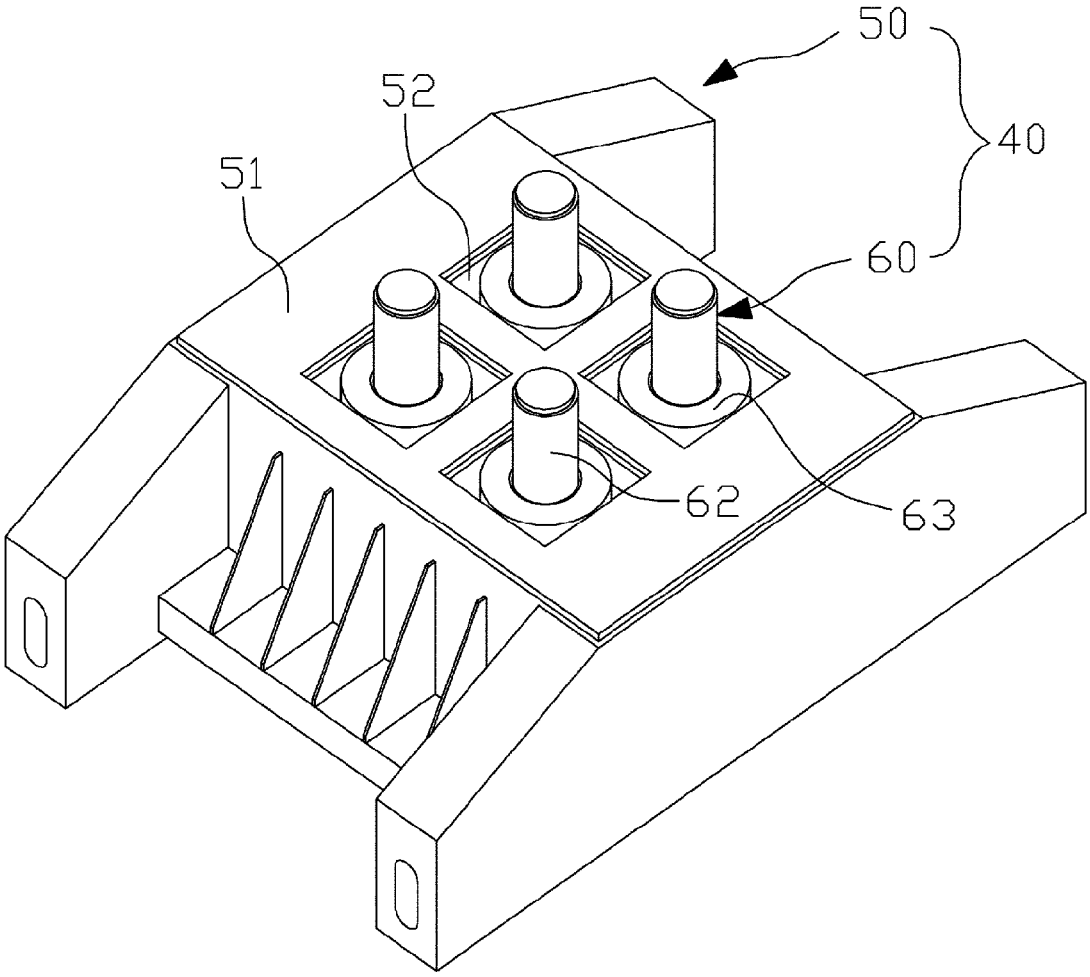
FIG. 5 is a perspective view illustrating an engaged state of the hydraulic height adjusting device according to one embodiment of the present invention.

FIG. 4 is an exploded perspective view illustrating the hydraulic height adjusting device 40 according to one embodiment of the present invention, and FIG. 5 is a perspective view illustrating the engaged state of the hydraulic height adjusting device 40.

Referring to FIGS. 3 to 5, the hydraulic height adjusting device 40 includes a lower frame 50 which is installed to a top surface of the carrier 10 and is provided with a plurality of receiving portions 52 formed in an upwardly opened shape, and a hydraulic cylinder 60 disposed in and engaged to the respective receiving portions 52 of the lower frame 50, the hydraulic cylinder 60 being moved in a vertical direction to adjust the height of the upper structure 30, in a state in which an upper end thereof supports the upper structure 30.

A base platform 12 is installed on the upper portion of the carrier 10, and the hydraulic height adjusting device 40 and the heavy-weight upper structure 30 are disposed on the base platform 12. After the heavy-weight upper structure 30 is manufactured on the ground, the heavy-weight upper structure 30 is transported to the sea by the carrier 10, with it being supported by the hydraulic height adjusting device 40 built with the hydraulic cylinder 60.

The receiving portion 52 of the lower frame 50 is a hole to receive the hydraulic cylinder 60 of the upper structure 30, and a load of the heavy-weight upper structure 30 is supported by a lower support 53 when the hydraulic cylinder 60 drives.

A shock absorption plate 51 is installed onto the hydraulic height adjusting device 40 to prevent the hydraulic height adjusting device 40 from being broken due to shock when the heavy-weight upper structure 30 is transported.

The hydraulic cylinder 60 quickly moves the heavy-weight upper structure 30 in the vertical direction according to working conditions, thereby safely and quickly installing the heavy-weight upper structure 30 on the sea.

Figure 6:
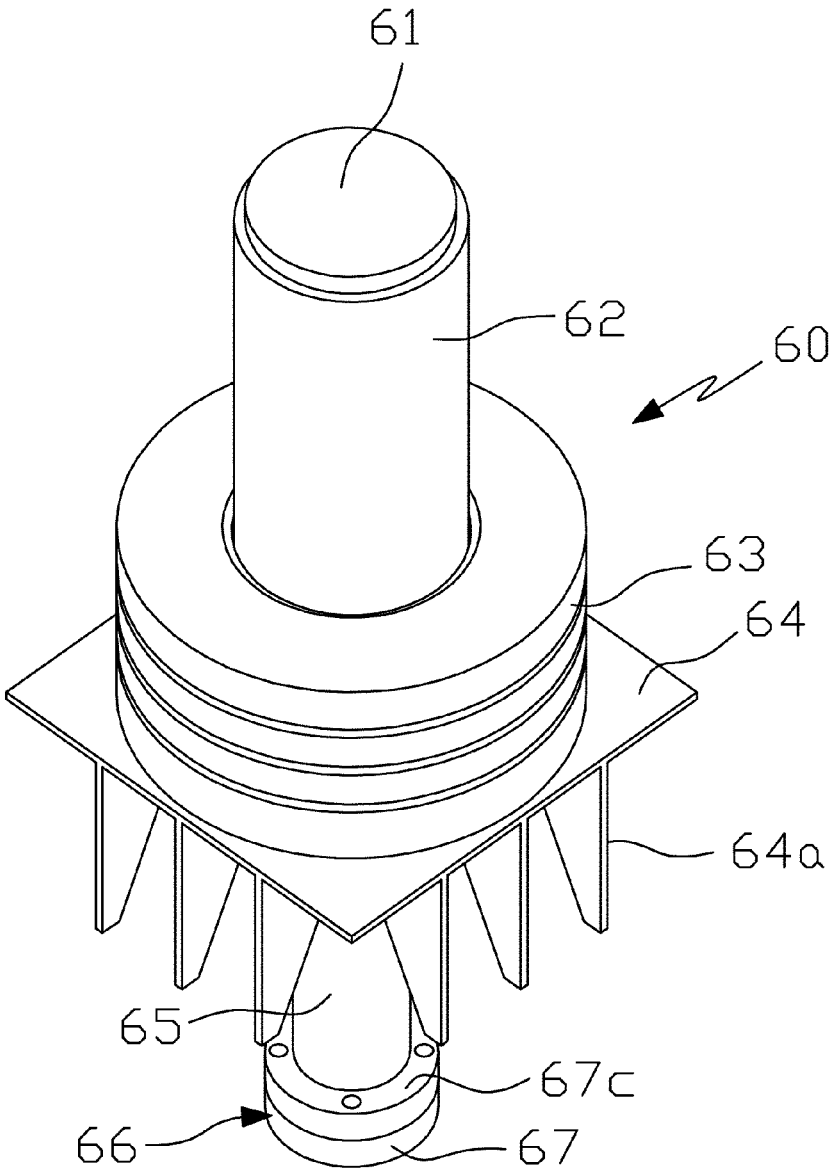
FIG. 6 is a perspective view illustrating a hydraulic cylinder of the hydraulic height adjusting device according to one embodiment of the present invention.

Referring to FIG. 6, the hydraulic cylinder 60 includes a hydraulic cylinder body 62 positioned at an upper portion, and a hydraulic cylinder rod 65 positioned at a lower portion and being moved in the vertical direction. a lower end of the hydraulic cylinder rod 65 is engaged to a bottom surface of the receiving portion 52 by a lower end engaging portion 66.

Figure 7:
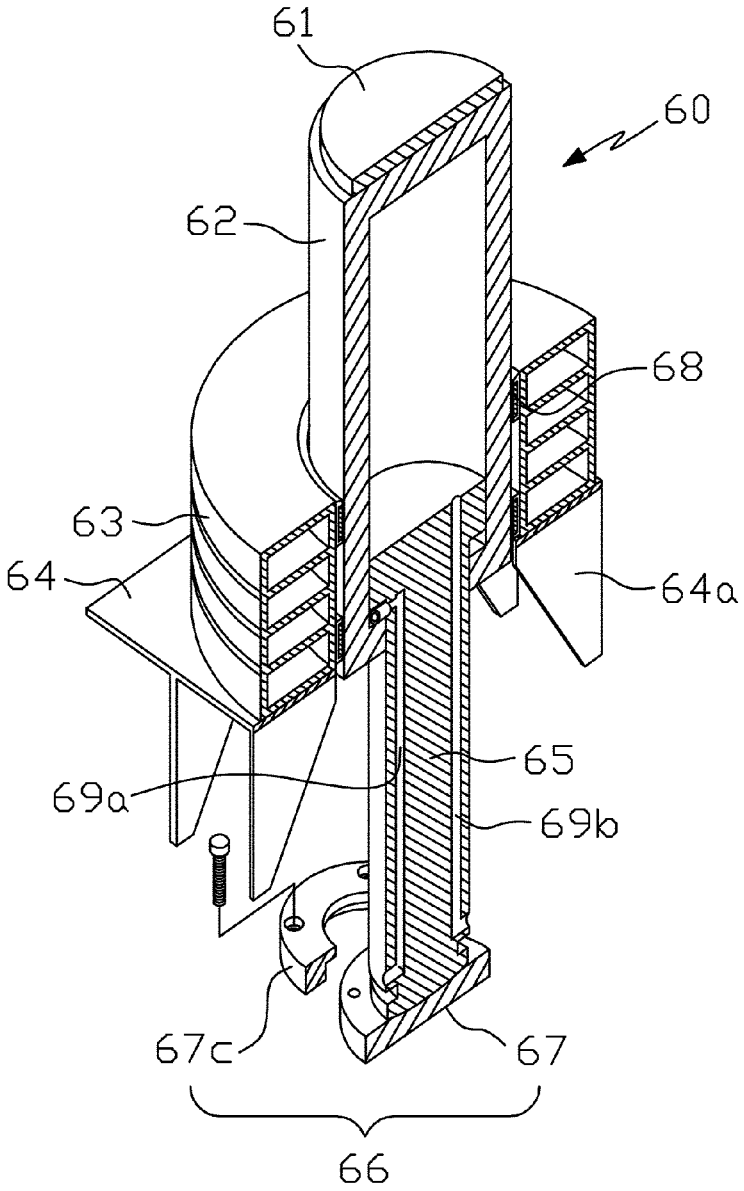
FIG. 7 is a cross-sectional view schematically illustrating the hydraulic cylinder of the hydraulic height adjusting device according to one embodiment of the present invention.
Figure 8:
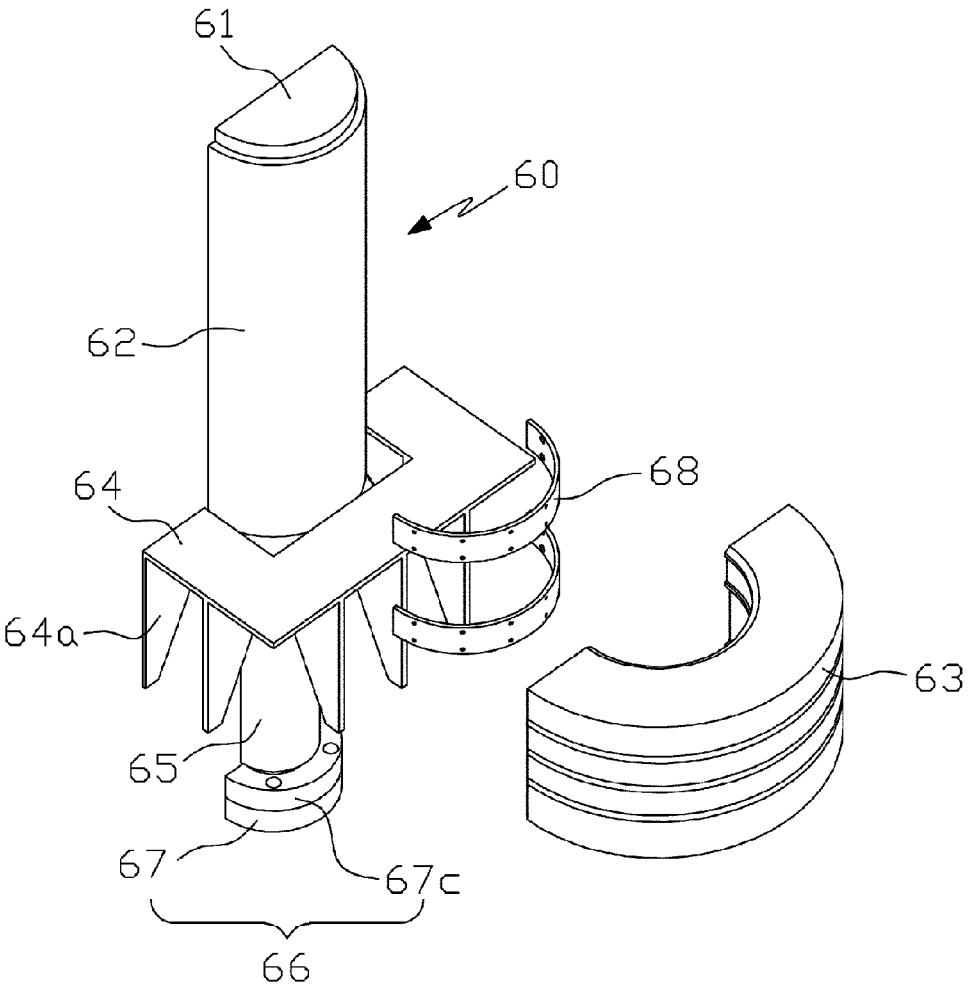
FIG. 8 is an exploded perspective view illustrating the hydraulic cylinder of the hydraulic height adjusting device according to one embodiment of the present invention.
Figure 9:
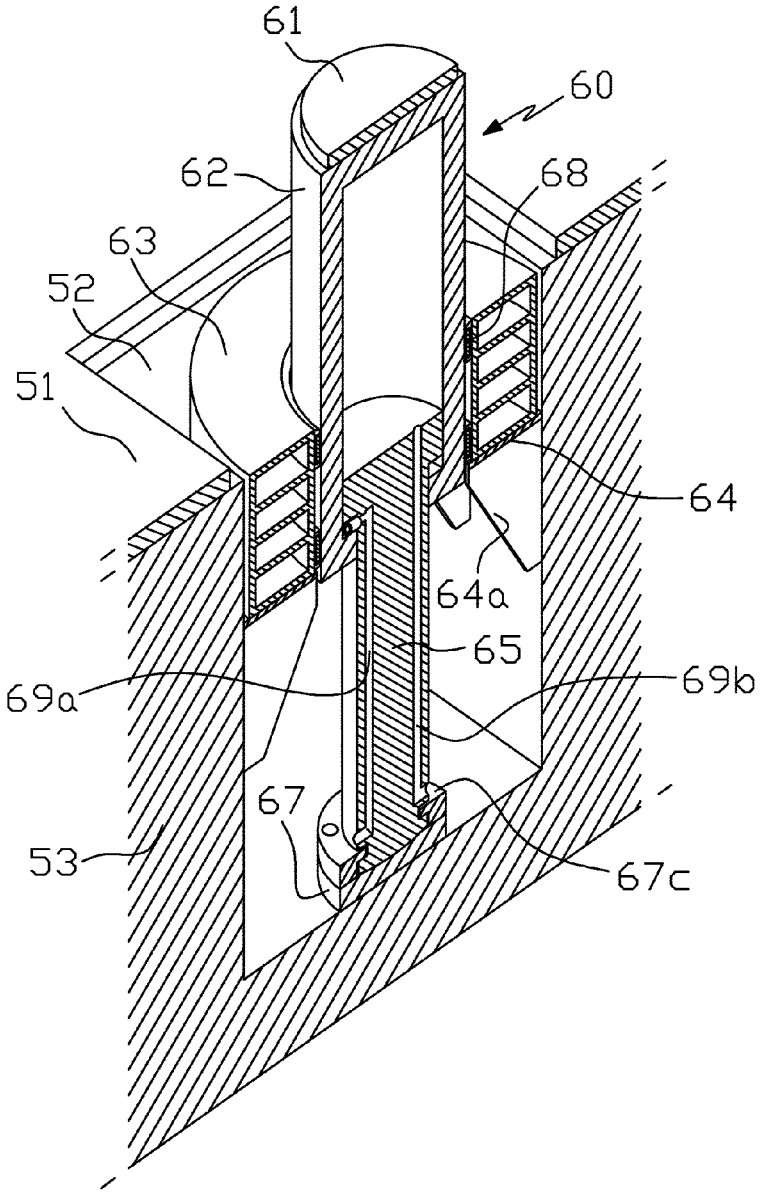
FIG. 9 is a cross-sectional view schematically illustrating a state in which the hydraulic cylinder of the hydraulic height adjusting device according to one embodiment of the present invention is installed to a lower frame.

FIG. 7 is a cross-sectional view schematically illustrating the hydraulic cylinder 60, FIG. 8 is an exploded perspective view illustrating the hydraulic cylinder 60, and FIG. 9 is a view illustrating the installed state of the hydraulic cylinder 60.

Referring to FIGS. 7 to 9, a shock absorption plate 61 is installed to an upper end of the hydraulic cylinder body 62 of the hydraulic height adjusting device 40 to prevent the hydraulic cylinder body 62 from being broken due to the contact of the heavy-weight upper structure 30 and the hydraulic cylinder body 62.

The hydraulic cylinder body 62 is plated with any material for the purpose of smooth contact between the outer surface of the hydraulic cylinder body 62 and a bearing pad 68 when the heavy-weight upper structure 30 moves up and down.

The receiving portion 52 is provided with a support guide 63 which is interposed between an inner wall of the receiving portion 52 and the hydraulic cylinder 60 to annually enclose the hydraulic cylinder 60 and thus prevent the hydraulic cylinder 60 from being tilted.

The support guide 63 encloses the outer surface of the hydraulic cylinder body 62, and supports the tilting of the hydraulic cylinder body 62 from a lateral side to support a horizontal load of the heavy-weight upper structure 30 which is placed on the hydraulic cylinder body 62, together with the hydraulic cylinder body 62.

A support guide base platform 64 is to set an installation position and support the load when the hydraulic cylinder 60 is installed in the receiving portion 52 of the lower frame 50.

The support guide base platform 64 has a plurality of brackets 64*a* welded to the inner wall of the receiving portion 52 to support the load by bearing the support guide 63 from the lower side. Since the support guide base platform 64 should not come into contact with the outer surface of the hydraulic cylinder body 62, a center hole, in which the hydraulic cylinder body 62 is positioned, is formed to be wider than a center hole of the support guide 63.

The bearing pad 68 is installed to the support guide 63 in the receiving portion 52 of the lower frame 50, and is in frictional contact with the hydraulic cylinder body 62 when the hydraulic cylinder body 62 moves up and down. The bearing pad 68 is made of special high-strength brass alloy.

Figure 10:
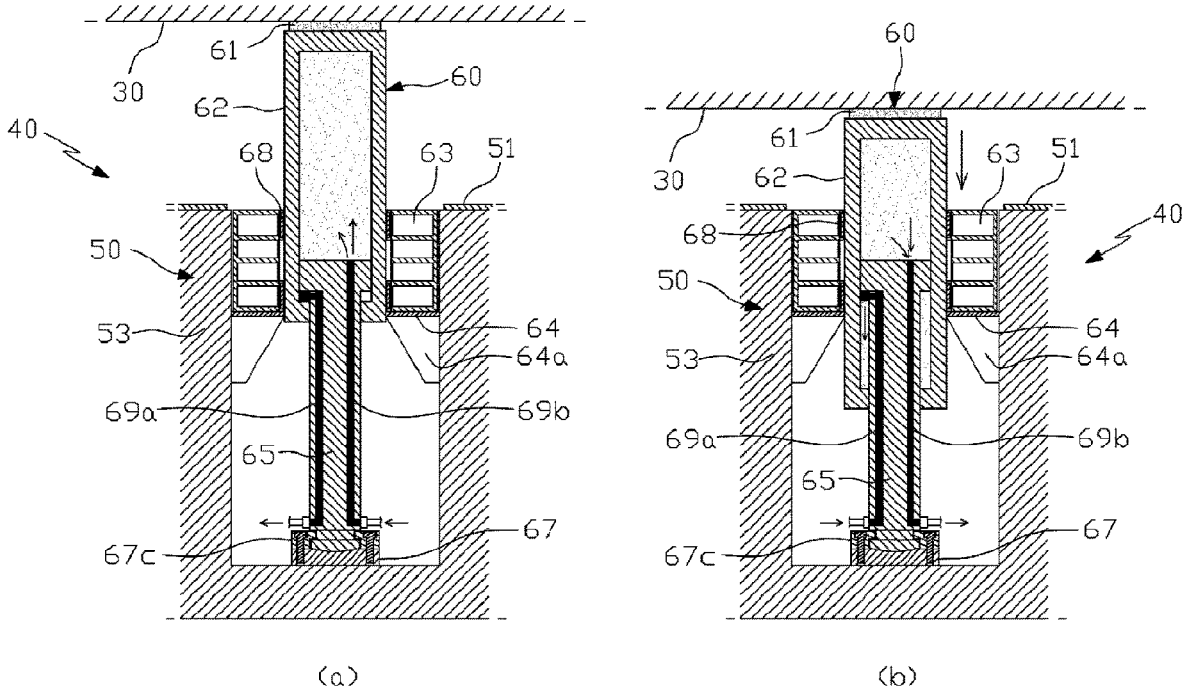
FIGS. 10*a* and 10*b* are views illustrating an operating state of the hydraulic cylinder of the hydraulic height adjusting device according to one embodiment of the present invention.

The hydraulic cylinder rod 65 is provided therein with a pair of fluid channels 69*a* and 69*b* along a longitudinal direction, and the pair of fluid channels 69*a* and 69*b* have inlet/outlet ports 69*c* and 69*d* at a lower end of the hydraulic cylinder rod 65, respectively, so that operating oil flows through the pair of fluid channels 69*a* and 69*b*. As illustrated in FIGS. 10*a* and 10*b*, the hydraulic cylinder body 62 moves along the hydraulic cylinder rod 65 in the vertical direction.

Figure 11:
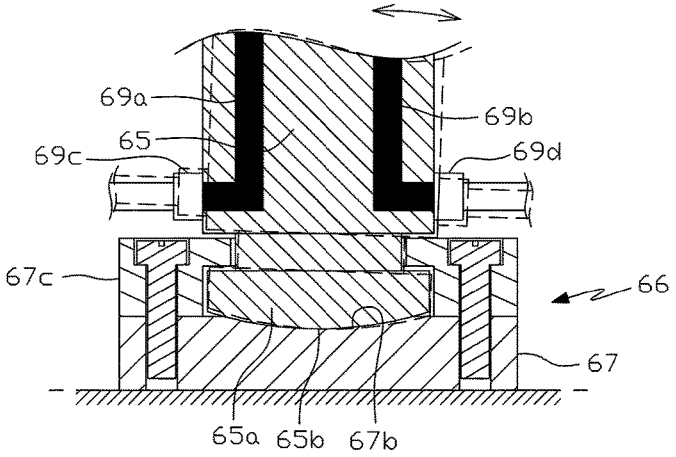
FIG. 11 is a cross-sectional view illustrating a lower structure of the hydraulic cylinder of the hydraulic height adjusting device according to one embodiment of the present invention.

Referring to FIG. 11, the lower end engaging portion 66 installed to the lower end of the hydraulic cylinder rod 65 has a bottom fixing member 67 fixed to the bottom of the receiving portion 52, a lower head portion 65*a* of the hydraulic cylinder rod 65 which comes into surface contact with the bottom fixing member 67 to allow the hydraulic cylinder rod 65 to move against the bottom fixing member 67, and a restrain member 67*c* for restraining the lower head portion 65*a* to prevent the lower head portion 65*a* from being released from the bottom fixing member 67.

The top surface of the bottom fixing member 67 has a concave surface 67*b*, and the bottom surface of the lower head portion 65*a* of the hydraulic cylinder rod 65 which comes into contact with the bottom fixing member 67 is a convex surface 65*b*, so that the convex surface 65*b* and the concave surface 67*b* come into surface contact with each other.

Also, there is a certain gap between the lower head portion 65*a* of the hydraulic cylinder rod 65 and the restrain member 67*c*, and the distal end of the hydraulic cylinder rod 65 is machined to have a rounded surface. As the hydraulic cylinder rod 65 comes into surface contact with the bottom fixing member 67, as illustrated by the dotted line in FIG. 11, the hydraulic cylinder rod 65 is allowed to be moved slightly. This movement allows the hydraulic cylinder part 60 to move very little when the horizontal load is applied to the carrier 10 or the upper structure 30, thereby preventing the lower end of the hydraulic cylinder part 60 engaged to the lower support 53 from becoming more and more fatigued.

With the above configuration, the bottom fixing member 67 is fixed to the bottom of the receiving portion 52, and thus supports the vertical load transmitted from the hydraulic cylinder rod 65, while being engaged to the hydraulic cylinder rod 65 with the contact to provide the hydraulic cylinder rod 65 with a free end.

The gap between the lower head portion 65*a* of the hydraulic cylinder rod 65 and the restrain member 67*c* controls a tilting angle of the hydraulic cylinder rod 65 within a range of ±5°.

According to the configuration of this embodiment described above, the hydraulic cylinder body 62 is installed at the upper side, while the hydraulic cylinder rod 65 is installed at the lower side, so that the upper end of the hydraulic cylinder body 62 supports the upper structure 30.

The structural factor of the cross section maximizes structural stability against the action of the force caused by the horizontal load by positioning the hydraulic cylinder body 62 on the hydraulic cylinder rod 65, as well as supporting the horizontal load by the support guide 63.

Also, the hydraulic cylinder rod 65 is designed to have the rounded lower end which satisfies the condition of the free end, thereby supporting the vertical load while allowing slight tilting against the horizontal load.

The hydraulic cylinder rod 65 is provided with at least two fluid channels 69*a* and 69*b* and the lower end of the hydraulic cylinder rod 65 is provided with the inlet/outlet ports 69*c* and 69*d*, so that the operating oil flows through the fluid channels 69*a* and 69*b*.

The channel for the operating oil to be fed to the hydraulic cylinder body 62 is not provided in the hydraulic cylinder body 62, but the hydraulic cylinder rod 65 is served as the channel for the operating oil. In the configuration of this embodiment in which the hydraulic cylinder body 62 is positioned at the upper side, the configuration through which the operating oil flows does not interrupt the vertical movement of the hydraulic cylinder body 62.

The configuration of the hydraulic cylinder 60 according to another embodiment of the present invention will now be described.

Figure 12:
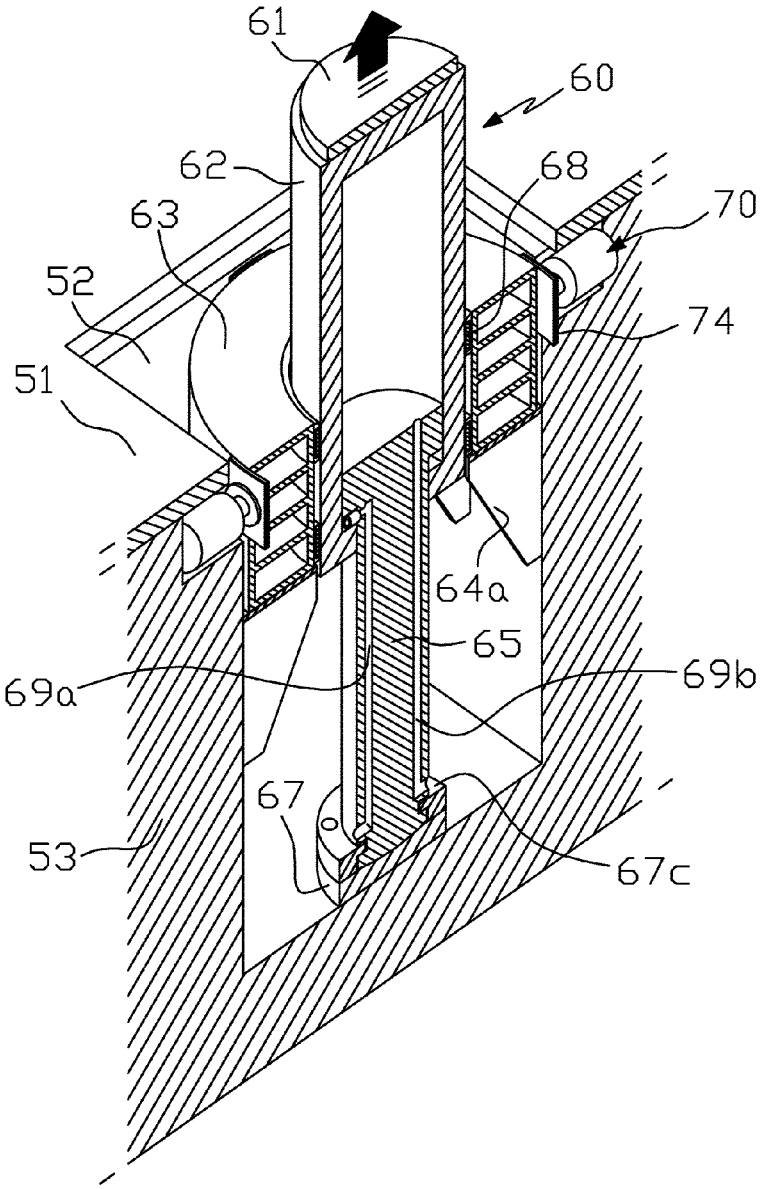
FIG. 12 is a cross-sectional view schematically illustrating an installed state of a lateral support part of a hydraulic height adjusting device according to another embodiment of the present invention.
Figure 13:
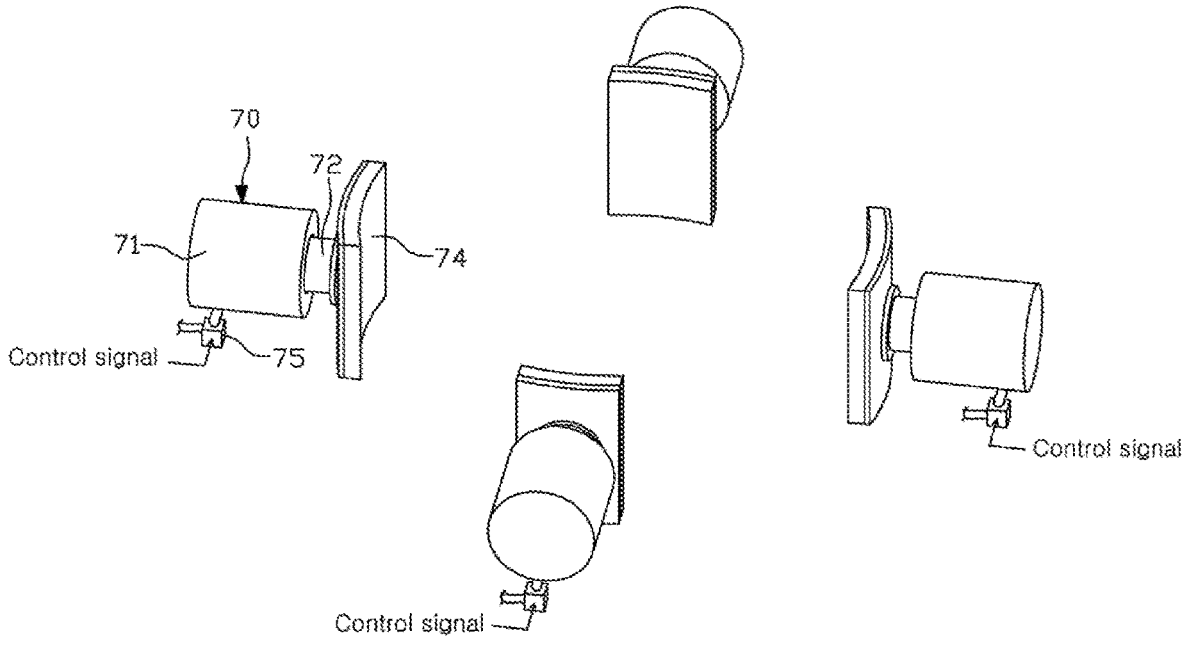
FIG. 13 is a perspective view illustrating the configuration of the lateral support part of a hydraulic height adjusting device according to another embodiment of the present invention.
Figure 14:
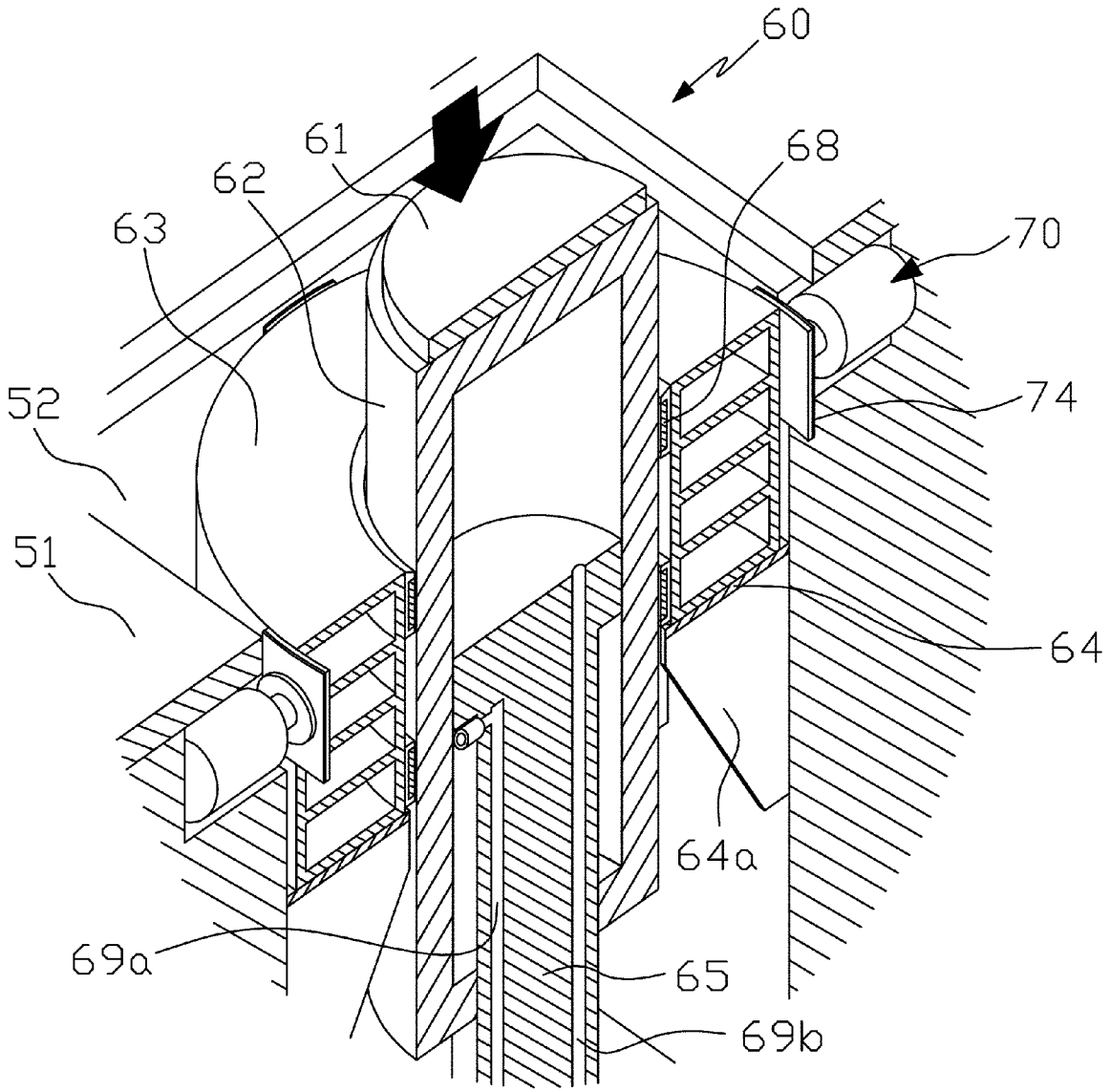
FIG. 14 is an enlarged cross-sectional view illustrating an installed portion of the lateral support part of a hydraulic height adjusting device according to another embodiment of the present invention.

FIGS. 12 to 14 are views illustrating the configuration of the hydraulic cylinder 60 according to another embodiment of the present invention.

A lateral support part 70 is designed to prevent the hydraulic cylinder body 62 from being tilted when the carrier 10 is relatively rolled side by side by the waves or wind.

Figure 16:
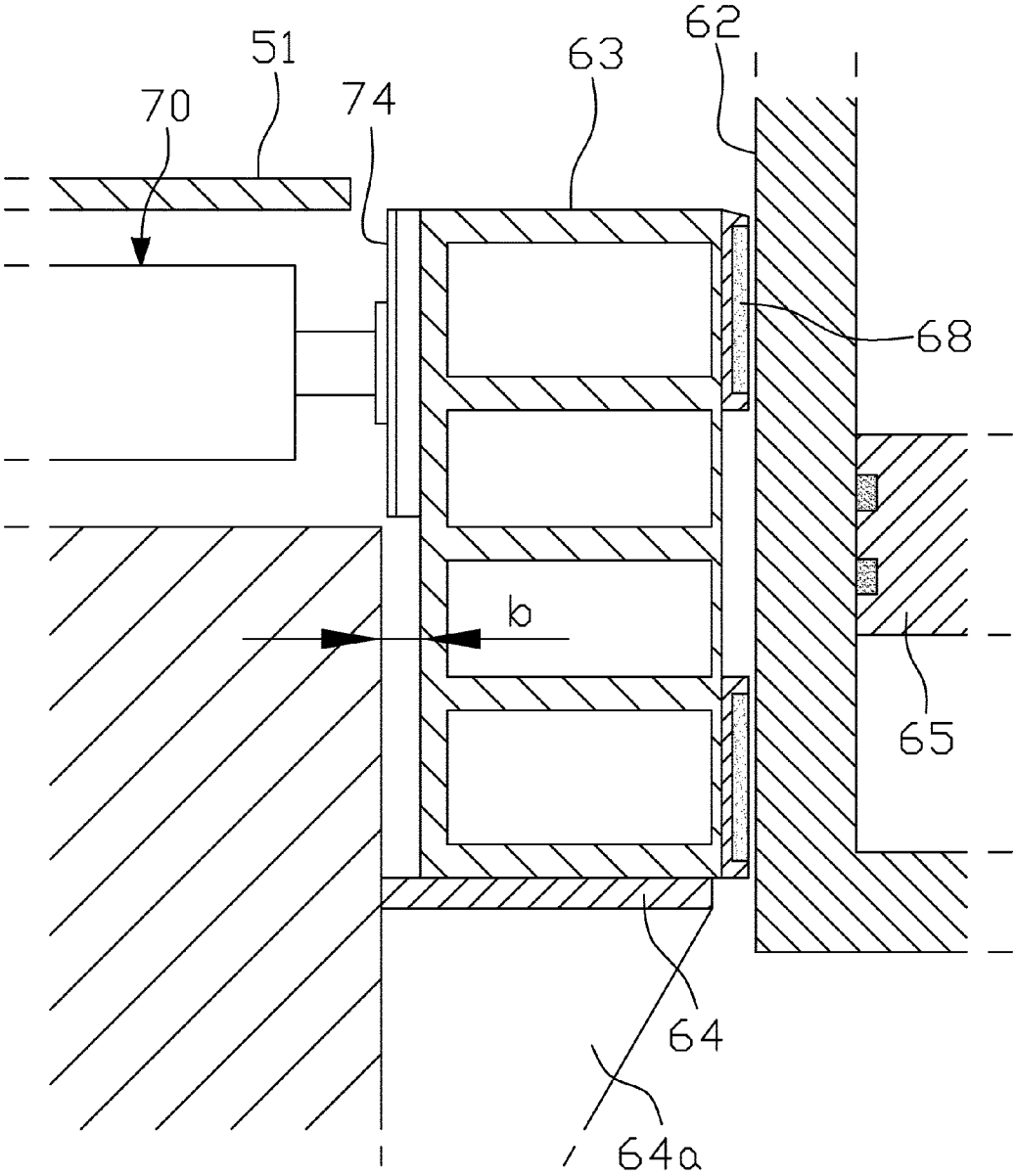
FIG. 16 is a view illustrating cooperation of the lateral support part and the hydraulic cylinder of the hydraulic height adjusting device according to another embodiment of the present invention.

Specifically, as illustrated in FIG. 16, since the hydraulic cylinder body 62 and the support guide 63 which are the huge structure are installed in the receiving portion 52 of the lower frame 50, there is an installation clearance, for example, a gap b, between the side wall of the receiving portion 52 and the support guide 63.

The lateral support part 70 is installed to prevent the hydraulic cylinder body 62 from being tilted, so that the hydraulic cylinder body 62 is maintained in the vertical standing state at the center portion of the receiving portion 52, in spite of the installation clearance.

Referring to FIG. 3, when the upper structure 30 is placed on the lower structure 20 on the sea, the horizontal rolling of the carrier 10 or the upper structure 30 should be suppressed until the complete placement is finished in the state in which both leg engaging portions 25 and 35 come close to each other in a predetermined range. The lateral support part 70 temporarily pushes and supports the hydraulic cylinder body 62 and the support guide 63 so that the hydraulic cylinder body 62 is maintained in the vertically standing state at the center portion of the receiving portion 52 during the placement.

FIG. 13 is a perspective view illustrating the configuration of the lateral support part 70, in which four lateral support parts 70 are installed in left and right directions and back and forth directions to prevent the hydraulic cylinder body 62 from being tilted above a certain level.

Figure 15:
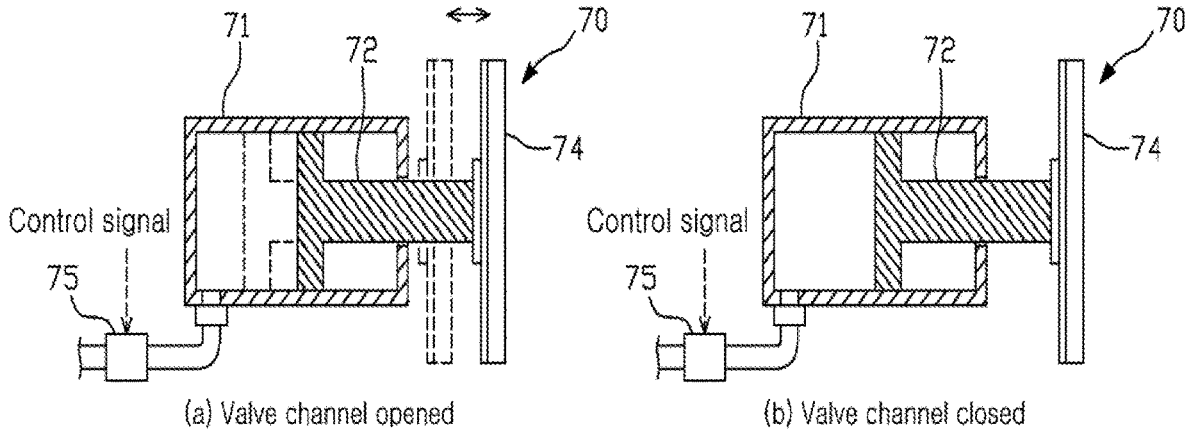
FIG. 15 is a view illustrating an operation of the lateral support part of a hydraulic height adjusting device according to another embodiment of the present invention.

As illustrated in FIG. 15, the lateral support part 70 includes a support cylinder body 71 installed to the lower frame 50, a support cylinder rod 72 disposed in the support cylinder body 71 and horizontally moving toward or away from the receiving portion 52 to apply the bearing power to the support guide 63, an opening/closing valve 75 for controlling the flow of the operating oil into or from the support cylinder body 71, and a controller for controlling operation of the opening/closing valve 75.

If the opening/closing valve 75 is closed by a control signal of the controller, the operating oil does not come out from the support cylinder body, thereby resisting the tilting of the hydraulic cylinder body 62.

The controller detects the horizontal movement by an acceleration sensor or the like, and controls the operation of the opening/closing valve 75 so that the lateral support parts 70 installed in all directions can support the hydraulic cylinder body 62.

Specifically, when the hydraulic cylinder body 62 is vertically stood, if the controller closes the opening/closing valve 75 according to the detection of the sensor, in the state in which a contact plate 74 of the lateral support part 70 comes into close contact with the support guide 63, the hydraulic cylinder body 62 is temporarily maintained in the vertical state, without being tilted slightly.

The present invention can be used as a hydraulic height adjusting device to be installed in a vessel, so as to safely place a heavy-weight structure, which is transported by the vessel, on a stationary structure on the sea. Also, the present invention can be used to adjust a height of the heavy-weight structure by lifting the heavy-weight structure, while supporting the heavy-weight structure on the vessel from a lower side.

What is claimed is:

1. A hydraulic height adjusting device for installing a heavy-weight structure to adjust a height of an upper structure by supporting the upper structure, the hydraulic height adjusting device comprising:

a lower frame which is provided with a plurality of receiving portions formed in an upwardly opened shape; and a hydraulic cylinder which is disposed in and engaged to the respective receiving portions of the lower frame, the hydraulic cylinder being movable in a vertical direction to adjust the height of the upper structure, in a state in which an upper end thereof supports the upper structure, wherein the receiving portion is provided with a support guide which is interposed between an inner wall of the receiving portion and the hydraulic cylinder to annually enclose the hydraulic cylinder and thus prevent the hydraulic cylinder from being tilted wherein four outer sides of the support guide are respectively provided with a lateral support part to support the support guide from a lateral direction, wherein the lateral support part includes a support cylinder body installed to the lower frame, a support cylinder rod disposed in the support cylinder body and horizontally moving toward or away from the receiving portion to apply bearing power to the support guide, an opening/closing valve for controlling flow of operating oil into or from the support cylinder body, and a controller for controlling operation of the opening/closing valve.

2. The hydraulic height adjusting device according to claim 1, wherein the hydraulic cylinder includes a hydraulic cylinder body positioned at an upper portion, and a hydraulic cylinder rod positioned at a lower portion and being movable in the vertical direction;

wherein a lower end of the hydraulic cylinder rod is engaged to a bottom surface of the receiving portion by a lower end engaging portion;

wherein the hydraulic cylinder rod is provided therein with a pair of fluid channels along a longitudinal direction;

wherein the pair of fluid channels have inlet/outlet ports at a lower end of the hydraulic cylinder rod, respectively, so that the operating oil flows through the pair of fluid channels, and the hydraulic cylinder body moves along the hydraulic cylinder rod in the vertical direction; and wherein the lower end engaging portion has a bottom fixing member fixed to a bottom of the receiving portion, a lower head portion of the hydraulic cylinder rod which comes into surface contact with the bottom fixing member to allow the hydraulic cylinder rod to move against the bottom fixing member, and a restrain member for restraining the lower head portion to prevent the lower head portion from being released from the bottom fixing member.

3. The hydraulic height adjusting device according to claim 2, wherein a top surface of the bottom fixing member has a concave surface which is a spherical surface, and a bottom surface of the lower head portion of the hydraulic cylinder rod which comes into contact with the bottom fixing member is a convex surface which is a spherical surface, so that the convex surface and the concave surface come into surface contact with each other to allow the movement.

4. An apparatus for installing a heavy-weight offshore structure to place an upper structure on a lower structure installed to a seabed, the apparatus comprising:

a carrier; and a hydraulic height adjusting device installed to an upper portion of the carrier at plural positions to support the upper structure and adjust a height thereof, the hydraulic height adjusting device including a lower frame which is installed on a top surface of the carrier and is provided with a plurality of receiving portions formed in an upwardly opened shape; and a hydraulic cylinder which is disposed in and engaged to the respective receiving portions of the lower frame, the hydraulic cylinder being movable in a vertical direction to adjust the height of the upper structure, in a state in which an upper end thereof supports the upper structure, wherein the receiving portion is provided with a support guide which is interposed between an inner wall of the receiving portion and the hydraulic cylinder to annually enclose the hydraulic cylinder and thus prevent the hydraulic cylinder from being tilted wherein four outer sides of the support guide are respectively provided with a lateral support part to support the support guide from a lateral direction, wherein the lateral support part includes a support cylinder body installed to the lower frame, a support cylinder rod disposed in the support cylinder body and horizontally moving toward or away from the receiving portion to apply bearing power to the support guide, an opening/closing valve for controlling flow of operating oil into or from the support cylinder body, and a controller for controlling operation of the opening/closing valve.

5. The apparatus for installing the heavy-weight offshore structure according to claim 4, wherein the hydraulic cylinder includes a hydraulic cylinder body positioned at an upper portion, and a hydraulic cylinder rod positioned at a lower portion and being movable in the vertical direction;

wherein a lower end of the hydraulic cylinder rod is engaged to a bottom surface of the receiving portion by a lower end engaging portion;

wherein the hydraulic cylinder rod is provided therein with a pair of fluid channels along a longitudinal direction;

wherein the pair of fluid channels have inlet/outlet ports at a lower end of the hydraulic cylinder rod, respectively, so that the operating oil flows through the pair of fluid channels, and the hydraulic cylinder body moves along the hydraulic cylinder rod in the vertical direction; and wherein the lower end engaging portion has a bottom fixing member fixed to a bottom of the receiving portion, a lower head portion of the hydraulic cylinder rod which comes into surface contact with the bottom fixing member to allow the hydraulic cylinder rod to move against the bottom fixing member, and a restrain member for restraining the lower head portion to prevent the lower head portion from being released from the bottom fixing member.

6. The apparatus for installing the heavy-weight offshore structure according to claim 5, wherein a top surface of the bottom fixing member has a concave surface which is a spherical surface, and a bottom surface of the lower head portion of the hydraulic cylinder rod which comes into contact with the bottom fixing member is a convex surface which is a spherical surface, so that the convex surface and the concave surface come into surface contact with each other to allow the movement.

* * * * *